US010001117B2

(12) United States Patent
Oikawa

(10) Patent No.: US 10,001,117 B2
(45) Date of Patent: Jun. 19, 2018

(54) CRYOPUMP SYSTEM, CRYOPUMP CONTROLLER, AND METHOD FOR REGENERATING THE CRYOPUMP

(71) Applicant: Sumitomo Heavy Industries, Ltd., Tokyo (JP)

(72) Inventor: Ken Oikawa, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 208 days.

(21) Appl. No.: 15/059,945

(22) Filed: Mar. 3, 2016

(65) Prior Publication Data

US 2016/0258429 A1 Sep. 8, 2016

(30) Foreign Application Priority Data

Mar. 4, 2015 (JP) ..... 2015-042523

(51) Int. Cl.
*B01D 8/00* (2006.01)
*F04B 37/08* (2006.01)

(52) U.S. Cl.
CPC ..... *F04B 37/085* (2013.01); *F04B 37/08* (2013.01)

(58) Field of Classification Search
CPC ..... F04B 37/085; F04B 37/08
USPC ..... 62/55.5
See application file for complete search history.

(56) References Cited

U.S. PATENT DOCUMENTS 5,819,545 A 10/1998 Eacobacci et al.
8,887,514 B2 * 11/2014 Kimura ..... F04B 37/08 62/268

FOREIGN PATENT DOCUMENTS

JP 2001-515176 A 9/2001
JP 4927642 B2 5/2012

* cited by examiner

*Primary Examiner* — Len Tran
*Assistant Examiner* — Ana Vazquez
(74) *Attorney, Agent, or Firm* — Michael Best & Friedrich LLP

(57) ABSTRACT

A cryopump controller includes a regeneration controller that controls a cryopump in accordance with a regeneration sequence including a condensate discharging process being continued until a discharging completion condition based on pressure in the cryopump is met. The regeneration controller includes a first determiner repetitively determining whether the discharging completion condition is met, a second determiner determining whether the number of times of determination for the completion condition or a period of time for which the discharging process continues is equal to or larger than a threshold value, and a temperature controller performing preliminary cooling of the cryopump if the number of times of determination for the completion condition or the period of time for which the discharging process continues is equal to or larger than the threshold value. The first determiner re-determines during the preliminary cooling whether the completion condition is met.

9 Claims, 4 Drawing Sheets

CRYOPUMP SYSTEM, CRYOPUMP CONTROLLER, AND METHOD FOR REGENERATING THE CRYOPUMP

RELATED APPLICATION

Priority is claimed to Japanese Patent Application No. 2015-042523, filed on Mar. 4, 2015, the entire content of which is incorporated herein by reference.

BACKGROUND OF THE INVENTION

1. Field of the Invention

The present invention relates to a cryopump system, a cryopump controller, and a method for regenerating the cryopump.

2. Description of the Related Art

A cryopump is a vacuum pump that traps and pumps gas molecules by condensing or adsorbing them on cryopanels cooled to ultracold temperatures. The cryopump is generally used to attain a clean vacuum environment required for a semiconductor circuit manufacturing process, for instance. The cryopump, which is a so-called entrapment vacuum pump, needs regeneration by which the trapped gas is periodically released to the outside.

SUMMARY OF THE INVENTION

An exemplary purpose of an embodiment of the present invention is to reduce the time required for regeneration of a cryopump.

According to an embodiment of the present invention, there is provided a cryopump system comprising: a cryopump; and a regeneration controller that controls the cryopump in accordance with a regeneration sequence including a discharging process for discharging a condensate from the cryopump, the discharging process being continued until a discharging completion condition based on pressure in the cryopump is met. The regeneration controller includes: a first determiner that determines in a repetitive manner whether the discharging completion condition is met; a second determiner that determines whether the number of times of determination for the discharging completion condition or a period of time for which the discharging process continues is equal to or larger than a first threshold value; and a temperature controller that performs preliminary cooling of the cryopump if the number of times of determination for the discharging completion condition or the period of time for which the discharging process continues is equal to or larger than the first threshold value. The first determiner re-determines during the preliminary cooling whether the discharging completion condition is met.

According to an embodiment of the present invention, there is provided a cryopump controller comprising: a regeneration controller that controls a cryopump in accordance with a regeneration sequence including a discharging process for discharging a condensate from the cryopump, the discharging process being continued until a discharging completion condition based on pressure in the cryopump is met. The regeneration controller includes: a first determiner that determines in a repetitive manner whether the discharging completion condition is met; a second determiner that determines whether the number of times of determination for the discharging completion condition or a period of time for which the discharging process continues is equal to or larger than a first threshold value; and a temperature controller that performs preliminary cooling of the cryopump if the number of times of determination for the discharging completion condition or the period of time for which the discharging process continues is equal to or larger than the first threshold value. The first determiner re-determines during the preliminary cooling whether the discharging completion condition is met.

According to an embodiment of the present invention, there is provided a method for regenerating a cryopump. The method comprises: controlling a cryopump in accordance with a regeneration sequence including a discharging process for discharging a condensate from the cryopump, the discharging process being continued until a discharging completion condition based on pressure in the cryopump is met. The controlling includes: determining in a repetitive manner whether the discharging completion condition is met; determining whether the number of times of determination for the discharging completion condition or a period of time for which the discharging process continues is equal to or larger than a first threshold value; performing preliminary cooling of the cryopump if the number of times of determination for the discharging completion condition or the period of time for which the discharging process continues is equal to or larger than the first threshold value; and re-determining during the preliminary cooling whether the discharging completion condition is met.

It is to be noted that an arbitrary combination of the above components and mutual substitution of the components and expressions of the present invention among an apparatus, a method, a system, a computer program, a recording medium in which the computer program is stored, and the like are valid as embodiments of the present invention.

DETAILED DESCRIPTION OF THE INVENTION

The invention will now be described by reference to the preferred embodiments. This does not intend to limit the scope of the present invention, but to exemplify the invention.

A detailed description of an embodiment to implement the present invention will be given with reference to the drawings. Like numerals are used in the description to denote like elements and the description is omitted as appropriate. The structure described below is by way of example only and does not limit the scope of the present invention.

Figure 1:
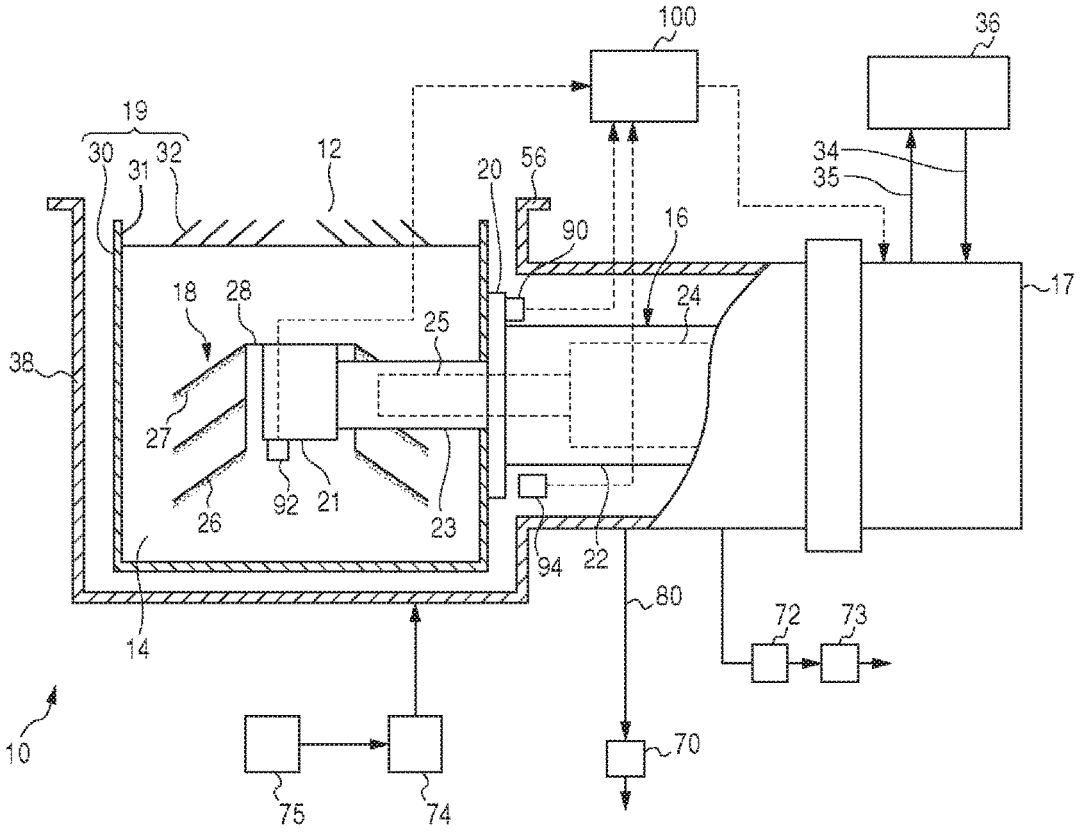
FIG. 1 is a schematic diagram showing a cryopump system according to an embodiment of the present invention.

FIG. 1 is a schematic view illustrating a cryopump system according to an embodiment of the present invention. The cryopump system includes a cryopump 10 and a cryopump control unit 100 for controlling a vacuum pumping operation and a regeneration operation of the cryopump 10. The cryopump 10, which is mounted, for example, to a vacuum chamber such as an ion implantation apparatus or a sputtering apparatus, is used to raise the degree of vacuum inside the vacuum chamber to a level required of a desired process. The cryopump control unit 100 may be provided integrally with the cryopump 10 or may be configured as a controller separate from the cryopump 10.

The cryopump 10 has an inlet 12 for receiving a gas. The inlet 12 is an entrance to an internal space 14 of the cryopump 10. A gas to be pumped enters the internal space 14 of the cryopump 10 through the inlet 12 from the vacuum chamber to which the cryopump 10 is mounted.

It is to be noted that the terms "axial direction" and "radial direction" may be used in the following description to clearly show the positional relationships between the constituent parts of the cryopump 10. The axial direction represents a direction passing through the inlet 12, whereas the radial direction represents a direction along the inlet 12. For convenience, with respect to the axial direction, positions relatively closer to the inlet 12 may be described using terms such as "above" and "upper", and positions relatively farther from the inlet 12 as "below" and "lower". That is, positions relatively farther from the bottom of the cryopump 10 may be described using terms such as "above" and "upper", and positions relatively closer thereto as "below" and "lower". With respect to the radial direction, positions closer to the center of the inlet 12 may be described using terms such as "inside" and "inward", and positions closer to the periphery of the inlet 12 as "outside" and "outward". However, it is to be noted that these descriptions do not limit to a specific location and/or orientation of the cryopump 10 as mounted to the vacuum chamber. For example, the cryopump 10 may be mounted to the vacuum chamber with the inlet 12 facing downward in the vertical direction.

The cryopump 10 includes a low-temperature cryopanel 18 and a high-temperature cryopanel 19. Further, the cryopump 10 includes a cooling system configured to cool the high-temperature cryopanel 19 and the low-temperature cryopanel 18. The cooling system includes a refrigerator 16 and a compressor 36.

The refrigerator 16 is a cryogenic refrigerator, such as, for example, a Gifford-McMahon refrigerator (so-called GM refrigerator). The refrigerator 16 is a two-stage type refrigerator including a first stage 20, a second stage 21, a first cylinder 22, a second cylinder 23, a first displacer 24, and a second displacer 25. Accordingly, the high-temperature stage of the refrigerator 16 includes the first stage 20, the first cylinder 22, and the first displacer 24. The low-temperature stage of the refrigerator 16 includes the second stage 21, the second cylinder 23, and the second displacer 25.

The first cylinder 22 and the second cylinder 23 are connected in series. The first stage 20 is installed in a joint portion between the first cylinder 22 and the second cylinder 23. The second cylinder 23 connects the first stage 20 and the second stage 21. The second stage 21 is installed at the end of the second cylinder 23. The first displacer 24 and the second displacer 25 are arranged inside the first cylinder 22 and the second cylinder 23, respectively, so as to be movable in the longitudinal direction of the refrigerator 16 (the horizontal direction in FIG. 1). The first displacer 24 and the second displacer 25 are connected together so as to be movable integrally. A first regenerator and a second regenerator (not illustrated) are installed within the first displacer 24 and the second displacer 25, respectively.

The refrigerator 16 includes a drive mechanism 17 provided at the high-temperature end of the first cylinder 22. The drive mechanism 17 is connected to the first displacer 24 and the second displacer 25 such that the first displacer 24 and the second displacer 25 can be moved in a reciprocal manner inside the first cylinder 22 and the second cylinder 23, respectively. The drive mechanism 17 includes a flow channel switching mechanism that switches the flow channels of a working gas such that supply and discharge of the gas are periodically repeated. The flow channel switching mechanism includes, for example, a valve unit and a drive unit for driving the valve unit. The valve unit includes, for example, a rotary valve, and the drive unit includes a motor for rotating the rotary valve. The motor may be, for example, an AC motor or a DC motor. The flow channel switching mechanism may be a mechanism of a direct acting type that is driven by a linear motor.

The refrigerator 16 is connected to the compressor 36 via a high-pressure conduit 34 and a low-pressure conduit 35. The refrigerator 16 generates cold on the first stage 20 and the second stage 21 by expanding, in the inside thereof, the high-pressure working gas (e.g., helium) supplied from the compressor 36. The compressor 36 recovers the working gas that has been expanded in the refrigerator 16, and increases the pressure thereof again to supply to the refrigerator 16.

More specifically, the drive mechanism 17 first communicates the high-pressure conduit 34 with the internal space of the refrigerator 16. The high-pressure working gas is supplied from the compressor 36 to the refrigerator 16 through the high-pressure conduit 34. When the internal space of the refrigerator 16 is filled with the high-pressure working gas, the drive mechanism 17 switches the flow channel so as to communicate the internal space of the refrigerator 16 with the low-pressure conduit 35. Thereby, the working gas is expanded. The expanded working gas is recovered into the compressor 36. In synchronization with such supply and discharge of the working gas, the first displacer 24 and the second displacer 25 move in a reciprocal manner inside the first cylinder 22 and the second cylinder 23, respectively. The refrigerator 16 generates cold on the first stage 20 and the second stage 21 by repeating such heat cycles.

The refrigerator 16 is configured to cool the first stage 20 to a first temperature level and the second stage 21 to a second temperature level. The second temperature level is lower than the first temperature level. For example, the first stage 20 is cooled to approximately 65 K to 120 K, and preferably to 80 K to 100 K, whereas the second stage 21 is cooled to approximately 10 K to 20 K.

In FIG. 1, both the central axis of the internal space 14 of the cryopump 10 and the central axis of the refrigerator 16 are on the paper. The cryopump 10 illustrated therein is a so-called horizontal cryopump. The horizontal cryopump generally means a cryopump in which the refrigerator 16 is so arranged as to intersect (normally intersect perpendicularly) with the central axis of the internal space 14 of the cryopump 10. Similarly, the present invention is applicable also to a so-called vertical cryopump. The vertical cryopump means a cryopump in which a refrigerator is arranged along the axial direction of the cryopump.

The low-temperature cryopanel 18 is provided in the central portion of the internal space 14 of the cryopump 10. The low-temperature cryopanel 18 includes, for example, a plurality of panel members 26. Each of the panel members 26 has, for example, the shape of a side surface of a truncated cone, so to speak, an umbrella-like shape. An adsorbent 27, such as activated carbon, is normally provided on each panel member 26. The adsorbent 27 is, for example, adhered to the rear surface of the panel member 26. Thus, the low-temperature cryopanel 18 includes an adsorption region for adsorbing gas molecules.

The panel members 26 are mounted to a panel mounting member 28. The panel mounting member 28 is mounted to the second stage 21. Thus, the low-temperature cryopanel 18 is thermally connected to the second stage 21. Accordingly, the low-temperature cryopanel 18 is cooled to the second temperature level.

The high-temperature cryopanel 19 includes a radiation shield 30 and an inlet cryopanel 32. The high-temperature cryopanel 19 is provided outside the low-temperature cryopanel 18 so as to surround the low-temperature cryopanel 18. The high-temperature cryopanel 19 is thermally connected to the first stage 20, and accordingly the high-temperature cryopanel 19 is cooled to the first temperature level.

The radiation shield 30 is provided mainly for protecting the low-temperature cryopanel 18 from the radiant heat from a housing 38 of the cryopump 10. The radiation shield 30 is located between the housing 38 and the low-temperature cryopanel 18 and encloses the low-temperature cryopanel 18. The axial upper end of the radiation shield 30 is opened toward the inlet 12. The radiation shield 30 has a tubular shape (e.g., cylindrical shape) whose axial lower end is closed, and is formed into a cup-like shape. A hole for mounting the refrigerator 16 is provided on a side surface of the radiation shield 30, and the second stage 21 is inserted into the radiation shield 30 therefrom. The first stage 20 is fixed, at the outer circumferential portion of the mounting hole, to the external surface of the radiation shield 30. Thus, the radiation shield 30 is thermally connected to the first stage 20.

The inlet cryopanel 32 is provided along the radial direction on the inlet 12. The inlet cryopanel 32 is disposed on a shield open end 31. The inlet cryopanel 32, with its outer periphery secured to the shield open end 31, is thermally coupled to the radiation shield 30. The inlet cryopanel 32 is provided axially above the low-temperature cryopanel 18. The inlet cryopanel 32 is formed into a louver structure or a chevron structure, for instance. The inlet cryopanel 32 maybe formed concentrically with the central axis of the radiation shield 30 or may be formed into a grid-like or any other shape.

The inlet cryopanel 32 is provided for pumping a gas entering the inlet 12. A gas that condenses at the temperature of the inlet cryopanel 32 (e.g., moisture) is captured on the surface of the inlet cryopanel 32. The inlet cryopanel 32 is provided also for protecting the low-temperature cryopanel 18 from the radiation heat from a heat source outside the cryopump 10 (e.g., a heat source inside the vacuum chamber to which the cryopump 10 is mounted). The inlet cryopanel 32 also restricts the entry of not only the radiation heat but also gas molecules. The inlet cryopanel 32 occupies part of the opening area of the inlet 12, thereby limiting the entry of a gas into the internal space 14 through the inlet 12 to a desired amount.

The cryopump 10 is provided with the housing 38. The housing 38 is a vacuum vessel separating the inside of the cryopump 10 from the outside. The housing 38 is so configured as to airtightly maintain the pressure inside the internal space 14 of the cryopump 10. The housing 38, which is provided outside the high-temperature cryopanel 19, encloses the high-temperature cryopanel 19. Also, the housing 38 has the refrigerator 16 therewithin. In other words, the housing 38 is a cryopump housing enclosing the high-temperature cryopanel 19 and the low-temperature cryopanel 18.

The housing 38 is fixed to a portion having the ambient temperature (e.g., a high-temperature part of the refrigerator 16) in such a manner that the housing 38 does not touch the high-temperature cryopanel 19 and a low-temperature part of the refrigerator 16. The external surface of the housing 38, which is exposed to the outside environment, has a temperature higher than that of the cooled high-temperature cryopanel 19 (e.g., approximately room temperature).

Also, the housing 38 has an inlet flange 56 extending radially outward from the opening end thereof. The inlet flange 56 serves as a flange by which to mount the cryopump 10 to the vacuum chamber. A gate valve (not shown) is provided at the opening of the vacuum chamber, and the inlet flange 56 is attached to the gate valve. Therefore, the gate valve is located axially above the inlet cryopanel 32. The gate valve may be closed when the cryopump 10 is regenerated, and the gate valve maybe opened when the vacuum chamber is evacuated by the cryopump 10.

A vent valve 70, a rough valve 72, and a purge valve 74 are connected to the housing 38.

The vent valve 70 is provided at one end of an exhaust line 80 for exhausting fluid from the internal space of the cryopump 10 to an external environment, for instance. Opening the vent valve 70 permits the flow of the exhaust line 80, whereas closing the vent valve 70 blocks the flow of the exhaust line 80. Though fluid to be discharged through the vent valve 70 is basically a gas, it may be liquid or a mixture of liquid and gas. For example, liquefied gas that has been condensed by the cryopump 10 may be mixed in the fluid to be discharged. By opening the vent valve 70, a positive pressure occurring within the housing 38 can be released to the outside.

The rough valve 72 is connected to a roughing pump 73. By opening or closing the rough valve 72, the roughing pump 73 and the cryopump 10 communicate with each other or are cut off from each other. Opening the rough valve 72 has the roughing pump 73 and the housing 38 communicate with each other. Closing the rough valve 72 cuts off the passage between the roughing pump 73 and the housing 38. By opening the rough valve 72 and operating the roughing pump 73, the inside of the cryopump 10 can be depressurized.

The roughing pump 73 is a vacuum pump for vacuum pumping of the cryopump 10. The roughing pump 73 is a vacuum pump configured to provide a base pressure zone or base pressure level of the cryopump 10. The base pressure zone covers a low-vacuum region in the workable pressure range of the cryopump 10. The base pressure zone includes an operation start pressure of the cryopump 10. The roughing pump 73 is capable of depressurizing the housing 38 from the atmospheric pressure to the base pressure zone. The base pressure zone covers a high-vacuum region of the roughing pump 73. Accordingly, the base pressure zone is included in an overlapped portion between the workable pressure range of the roughing pump 73 and that of the cryopump 10. For example, the base pressure zone is in the range of 1 Pa to 50 Pa, both inclusive. For example, the base pressure zone is on the order of 10 Pa.

Typically, the roughing pump 73 is provided as a vacuum device separate from the cryopump 10. For example, the roughing pump 73 constitutes a part of a vacuum system that includes the vacuum chamber to which the cryopump 10 is connected. The cryopump 10 is a main pump for the vacuum chamber and the roughing pump 73 is an auxiliary pump.

The purge valve 74 is connected to a purge gas supplier including a purge gas source 75. By opening or closing the purge valve 74, the purge gas source 75 and the cryopump 10 communicate with each other or are cut off from each other. Supply of the purge gas to the cryopump 10 is controlled accordingly. The flow of the purge gas from the purge gas source 75 to the housing 38 is permitted by opening the purge valve 74. The flow of the purge gas from the purge gas source 75 to the housing 38 is cut off by closing the purge valve 74. By opening the purge valve 74 and introducing the purge gas from the purge gas source 75 to the housing 38, the pressure inside the cryopump 10 can be raised. The supplied purge gas is discharged from the cryopump 10 via the vent valve 70 or the rough valve 72.

According to the embodiment, the temperature of the purge gas is controlled to the room temperature. In alternative embodiments, the purge gas may be heated to a temperature higher than the room temperature or a temperature slightly lower than the room temperature. In this specification, the room temperature is defined to be a temperature selected from a range 10° C.-30° C. or a range 15° C.-25° C. For example, the room temperature may be 20° C. The purge gas is a nitrogen gas, for instance. The purge gas may be a dry gas.

The cryopump 10 includes a first temperature sensor 90 for measuring the temperature of the first stage 20 and a second temperature sensor 92 for measuring the temperature of the second stage 21. The first temperature sensor 90 is mounted to the first stage 20. The second temperature sensor 92 is mounted to the second stage 21. The first temperature sensor 90 measures the temperature of the first stage 20 periodically and outputs a signal indicating the measured temperature to the cryopump control unit 100. The first temperature sensor 90 is connected to the cryopump control unit 100 so that the output from the first temperature sensor 90 can be communicated to the cryopump control unit 100. The second temperature sensor 92 is configured similarly. Alternatively, the temperature measured by the first temperature sensor 90 may be used as indicating the temperature of the high-temperature cryopanel 19, and the temperature measured by the second temperature sensor 92 may be used as indicating the temperature of the low-temperature cryopanel 18.

A pressure sensor 94 is provided inside the housing 38. The pressure sensor 94 is located outside the high-temperature cryopanel 19 and is provided near the refrigerator 16, for instance. The pressure sensor 94 measures the pressure within the housing 38 periodically and outputs a signal indicating the measured pressure to a cryopump control unit 100. The pressure sensor 94 is connected to the cryopump control unit 100 so that the signal outputted from the pressure sensor 94 can be supplied to the control unit 100.

The cryopump control unit 100 is so configured as to control the refrigerator 16 to carryout a vacuum pumping operation and a regeneration operation of the cryopump 10. The cryopump control unit 100 is configured such that the measurement results of various sensors such as the first temperature sensor 90, the second temperature sensor 92 and the pressure sensor 94 can be received. Based on those measurement results, the cryopump control unit 100 computes instructions given to the refrigerator 16 and the valves.

In the vacuum pumping operation, the cryopump control unit 100 controls the refrigerator 16 in such a manner, for example, that a stage temperature (e.g., first-stage temperature) follows a target cooling temperature. The target temperature of the first stage 20 is typically set to a constant value. The target temperature of the first stage 20 is determined to be a certain value as specifications according to a process performed in the vacuum chamber attached to the cryopump 10. The cryopump control unit 100 is configured to control gas evacuation from the housing 38 and supply of the purge gas to the housing 38 for regeneration of the cryopump 10. The cryopump control unit 100 controls the opening and closing of the vent valve 70, the rough valve 72 and the purge valve 74 during regeneration.

An operation of the cryopump 10 configured as above is now explained hereunder. As the cryopump 10 is to be operated, the interior of the cryopump 10 is first roughly evacuated to an operation start pressure (e.g., about 1 Pa-10 Pa) by using the roughing pump 73 through the rough valve 72 before the operation starts. Then the cryopump 10 is operated. The first stage 20 and the second stage 21 are cooled under the control of the cryopump control unit 100 by driving the refrigerator 16. This also cools the high-temperature cryopanel 19 and the low-temperature cryopanel 18 that are thermally coupled to the first stage 20 and the second stage 21, respectively.

The inlet cryopanel 32 cools gases coming from the vacuum chamber into the cryopump 10 and condenses a gas, whose vapor pressure gets sufficiently low by this cooling temperature (e.g., water or the like), on the surface of the inlet cryopanel 32 so that the gas is removed from the vacuum chamber. On the other hand, gases, whose vapor pressure does not become sufficiently low by the cooling temperature of the inlet cryopanel 32, passes through the inlet cryopanel 32 and enters inside the radiation shield 30. Of the gases that have entered inside the radiation shield 30, a gas whose vapor pressure becomes sufficiently low by the cooling temperature of the low-temperature cryopanel 18 is condensed for removal on a surface of the low-temperature cryopanel 18. Gases, whose vapor pressure does not become sufficiently low even by the cooling temperature of the low-temperature cryopanel 18 (e.g., hydrogen or the like), is adsorbed for removal by an adsorbent 27 adhered to the surface of the low-temperature cryopanel 18. In this manner, the cryopump 10 can attain a desired degree of vacuum in the vacuum chamber attached to the cryopump 10.

As the pumping operation continues, the gases are accumulated in the cryopump 10. In order that the accumulated gases can be discharged to the outside, the cryopump 10 is regenerated. The cryopump control unit 100 determines whether a predetermined regeneration-start condition is satisfied, and starts the regeneration if the condition is satisfied. If the condition is not satisfied, the cryopump control unit 100 will not start the regeneration and continue the vacuum pumping operation. The regeneration-start condition may include a condition where a predetermined length of time has elapsed after the start of the pumping operation, for instance.

Figure 2:
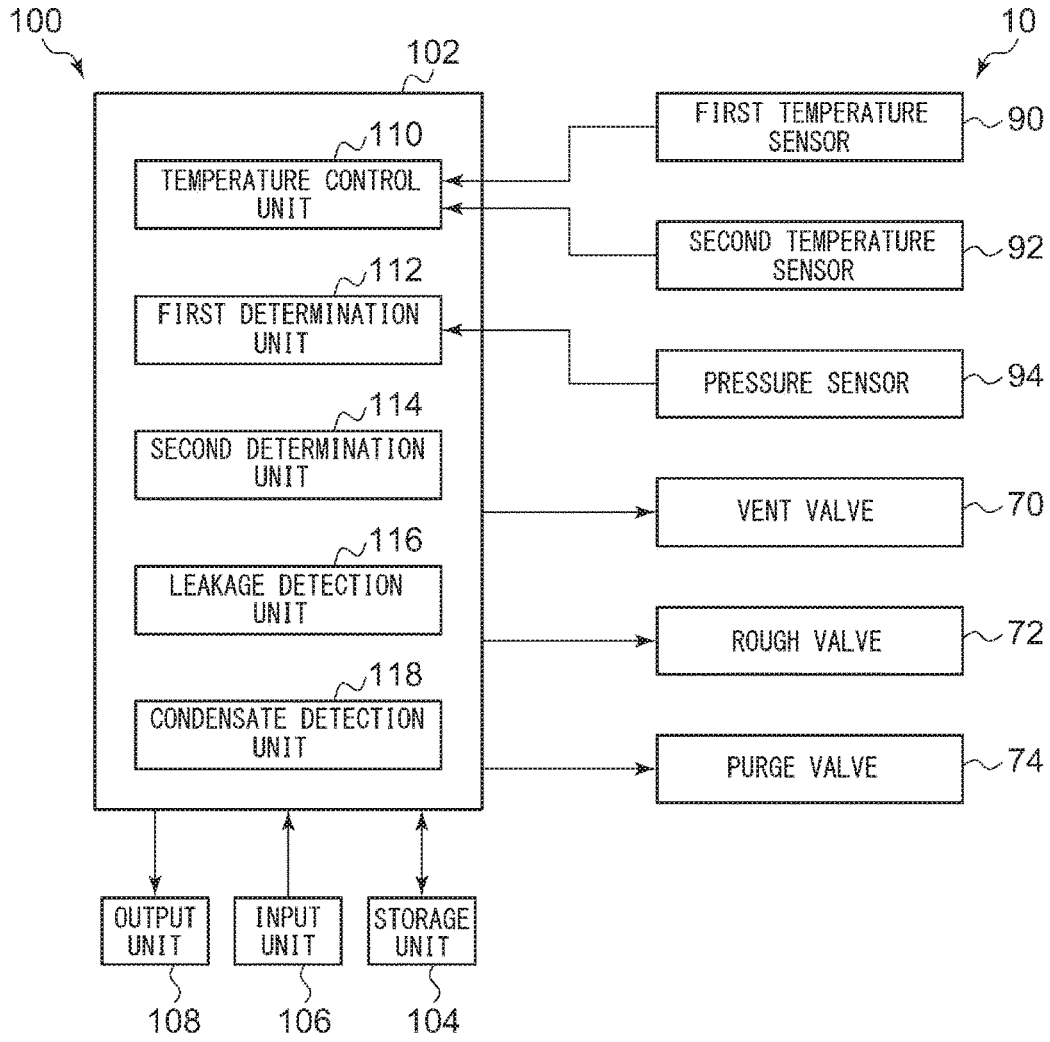
FIG. 2 is a schematic diagram showing a configuration of a cryopump control unit according to an embodiment of the present invention.

FIG. 2 is a schematic view illustrating a configuration of the cryopump control unit 100 according to an embodiment of the present invention. Such a controller is achieved by hardware, software, or combination thereof. Also, FIG. 2 schematically illustrates relevant parts of the cryopump 10.

The cryopump control unit 100 includes a regeneration control unit 102, a storage unit 104, an input unit 106, and an output unit 108.

The regeneration control unit 102 or the regeneration controller is configured to control the cryopump 10 in accordance with a regeneration sequence including a temperature-raising process, a discharging process, and a cooldown process. The regeneration sequence provides a full regeneration of the cryopump 10, for instance. The full regeneration regenerates all cryopanels including the high-temperature cryopanel 19 and the low-temperature cryopanel 18. Meanwhile, the regeneration control unit 102 may control the cryopump 10 in accordance with a regeneration sequence for a partial regeneration.

The storage unit 104 is configured to store information related to control of the cryopump 10. The input unit 106 is configured to receive an input from a user or another apparatus. Examples of the input unit 106 are an input means configured to receive an input from a user such as a mouse and a keyboard and/or a communication means configured to communicate with another apparatus. The output unit 108 is configured to output information related to control of the cryopump 10, and an example thereof is an output means such as a display and a printer. The storage unit 104, the input unit 106, and the output unit 108 are respectively connected to the regeneration control unit 102 to enable communication with the regeneration control unit 102.

The regeneration control unit 102 includes a temperature control unit 110, a first determination unit 112, a second determination unit 114, a leakage detection unit 116, and a condensate detection unit 118. The temperature control unit 110 or the temperature controller is configured to control the cryopump 10 to set the temperature of the low-temperature cryopanel 18 and/or the high-temperature cryopanel 19 to a target temperature that is preset in the regeneration sequence. The temperature control unit 110 uses the temperature measured by the first temperature sensor 90 and/or the second temperature sensor 92 as the temperature of the low-temperature cryopanel 18 and/or the high-temperature cryopanel 19. The regeneration control unit 102 is also configured to open or close the vent valve 70, the rough valve 72, and/or the purge valve 74 in accordance with the regeneration sequence. The first determination unit 112, the second determination unit 114, the leakage detection unit 116, and the condensate detection unit 118 will be described below.

The temperature-raising process is a first process of regeneration to heat the low-temperature cryopanel 18 and/or the high-temperature cryopanel 19 of the cryopump 10 from an ultracold or cryogenic temperature Tb to a first regeneration temperature T0. The ultracold temperature Tb is a standard operation temperature of the cryopump 10 and includes an operation temperature Tb1 of the high-temperature cryopanel 19 and an operation temperature Tb2 of the low-temperature cryopanel 18. As described above, the operation temperature Tb1 of the high-temperature cryopanel 19 is selected from the range of 65 K to 120 K, for instance, while the operation temperature Tb2 of the low-temperature cryopanel 18 is selected from the range of 10 K to 20 K, for instance.

The first regeneration temperature T0 is a cryopanel target temperature in the temperature-raising process and is equal to or higher than the melting point of a first condensate. The first condensate is a principal component or a component of a condensate accumulated in the cryopump 10. An example of the first condensate is water, in which case, the first regeneration temperature T0 is 273 K or higher. The first regeneration temperature T0 may be a room temperature or higher. The first regeneration temperature T0 may be a heatproof temperature or upper temperature limit of the cryopump 10 or lower. The heatproof temperature of the cryopump 10 may be approximately 320 K to 340 K, for instance (approximately 330 K, for instance).

The temperature control unit 110 controls at least one heat source provided in the cryopump 10 to set the temperature of the low-temperature cryopanel 18 and/or the high-temperature cryopanel 19 to the target temperature. For example, the temperature control unit 110 may open the purge valve 74 so as to supply the purge gas to the housing 38 in the temperature-raising process. The temperature control unit 110 may also close the purge valve 74 so as to stop supplying the purge gas to the housing 38. In this manner, the purge gas may be used as a first heat source to heat the low-temperature cryopanel 18 and/or the high-temperature cryopanel 19 in the temperature-raising process.

A second heat source different from the purge gas may be used to heat the low-temperature cryopanel 18 and/or the high-temperature cryopanel 19. For example, the temperature control unit 110 may control the temperature-raising operation of the refrigerator 16. The refrigerator 16 is configured such that the working gas undergoes adiabatic compression when the drive mechanism 17 operates in a direction opposite to that of the cooling operation. The refrigerator 16 heats the first stage 20 and the second stage 21 with the obtained compression heat. Such heating is called reversal heating of the refrigerator 16. The high-temperature cryopanel 19 is heated by the first stage 20 as the heat source, and the low-temperature cryopanel 18 is heated by the second stage 21 as the heat source. Alternatively, a heater provided in the refrigerator 16 may be used as the heat source. In this case, the temperature control unit 110 can control the heater independent of the operation of the refrigerator 16.

In the temperature-raising process, one of the first and second heat sources may be used alone. Alternatively, the two heat sources maybe used at the same time. In the discharging process, as in the temperature-raising process, one of the first and second heat sources may be used alone or both may be used at the same time. The temperature control unit 110 may switch between the first and second heat sources or use the first and second heat sources in conjunction so as to set the temperature of the low-temperature cryopanel 18 and/or the high-temperature cryopanel 19 to the target temperature.

The temperature control unit 110 determines whether the measured temperature of the cryopanels reaches the target temperature. The temperature control unit 110 continues temperature raising until the target temperature is met and terminates the temperature-raising process if the target temperature is met. When the temperature-raising process is terminated, the regeneration control unit 102 starts the discharging process.

In the temperature-raising process, a condensate and/or an adsorbed substance on the low-temperature cryopanel 18 and/or the high-temperature cryopanel 19, such as another condensate component having higher vapor pressure than that of the first condensate, maybe discharged from the cryopump 10. The regeneration control unit 102 may open the vent valve 70 and/or the rough valve 72 and then close the vent valve 70 and/or the rough valve 72 at proper timings to discharge the condensate and/or the adsorbed substance from the housing 38.

The discharging process is a second process of regeneration to discharge the condensate and/or the adsorbed substance from the cryopump 10. At the ultracold temperature Tb, the condensate and/or the adsorbed substance are/is on the low-temperature cryopanel 18 and/or the high-temperature cryopanel 19. In the procedure of heating from the ultracold temperature Tb to the first regeneration temperature T0, the condensate and/or the adsorbed substance are/is re-vaporized. The temperature control unit 110 continues temperature control of the low-temperature cryopanel 18 and/or the high-temperature cryopanel 19 to the first regeneration temperature T0 or another target temperature in the discharging process.

The gas re-vaporized from the surface of the cryopanels is discharged outside the cryopump 10. The re-vaporized gas is discharged outside via the exhaust line 80 or by using the roughing pump 73, for instance. The re-vaporized gas is discharged, together with the purge gas introduced, from the cryopump 10 as necessary.

The regeneration control unit 102 continues the discharging process until a discharging completion condition is met. The discharging completion condition is based on the pressure in the cryopump 10 such as pressure measured by the pressure sensor 94. For example, the regeneration control unit 102 determines the condensate remains in the cryopump 10 if the measured pressure in the housing 38 exceeds a predetermined threshold value. The cryopump 10 thus continues the discharging process. The regeneration control unit 102 determines the condensate has been discharged if the measured pressure in the housing 38 falls below the threshold value. In this case, the regeneration control unit 102 terminates the discharging process and starts the cooldown process.

The regeneration control unit 102 may use a so-called buildup test. The buildup test in the cryopump regeneration is a process to determine that the condensate is properly discharged from the cryopump 10 if the pressure rise slope from the initial pressure at the start of the test does not exceed a threshold for the test. This is also called an RoR (Rate-of-Rise) method. Accordingly, the regeneration control unit 102 may terminate the discharging process if the pressure rise amount per unit time at the base pressure level is smaller than the threshold.

The first determination unit 112 or the first determiner of the regeneration control unit 102 is configured to determine in a repetitive manner whether the discharging completion condition is met. The first determination unit 112 may determine that the discharging completion condition is met if the buildup test is passed. That is, the first determination unit 112 may determine that the discharging completion condition is met if the pressure in the housing 38 measured by the pressure sensor 94 is maintained at the operation start pressure of the cryopump 10 or lower for a predetermined period of time.

The second determination unit 114 or the second determiner is configured to determine whether the number of times of determination for the discharging completion condition is equal to or larger than a first threshold value A1. The first threshold value A1 is larger than a standard number of times of determination A0 for the discharging completion condition. The standard number of times of determination A0 is the number of times of determination normally required until the first condensate is removed from the cryopump 10 in the regeneration sequence. For example, suppose that certain cryopumps complete discharging of the first condensate after the discharging completion condition is determined A0 times (i.e., after A0 cycles of determination) in a given regeneration sequence. In this case, the first threshold value A1 is set to be larger than the standard number of times A0 (A1=A0+1, for instance). The standard number of times of determination A0 can be obtained as needed empirically or by experiment.

The temperature control unit 110 is configured to perform preliminary cooling of the cryopump 10 if the number of times of determination for the discharging completion condition is equal to or larger than the first threshold value A1. The preliminary cooling of the cryopump 10 is a process for cooling the low-temperature cryopanel 18 and/or the high-temperature cryopanel 19 to a second regeneration temperature Ta in a preliminary manner. The second regeneration temperature Ta is a cryopanel target temperature in the preliminary cooling process and is higher than the standard operation temperature of the cryopump 10 and lower than the melting point of the first condensate. The second regeneration temperature Ta may be higher than approximately 200 K and lower than approximately 273 K.

Since the first determination unit 112 determines in a repetitive manner whether the discharging completion condition is met, the first determination unit 112 re-determines during the preliminary cooling of the cryopump 10 whether the discharging completion condition is met. The condensate detection unit 118 or the condensate detector is configured to detect a second condensate remains if the discharging completion condition is met during the preliminary cooling of the cryopump 10. The second condensate is different from the first condensate and has lower vapor pressure than that of the first condensate. An example of the second condensate is an organic condensate. The condensate detection unit 118 may output a detection result to the output unit 108.

The second determination unit 114 determines during the preliminary cooling of the cryopump 10 whether the number of times of determination for the discharging completion condition is equal to or larger than a second threshold value A2. The second threshold value A2 may be equal to or different from the first threshold value A1. The leakage detection unit 116 or the leak detector is configured to detect leakage of the cryopump 10 if the number of times of determination for the discharging completion condition is equal to or larger than the second threshold value A2. The leakage detection unit 116 may output a detection result to the output unit 108.

The storage unit 104 stores regeneration parameters for defining the regeneration sequence. The regeneration parameters are obtained empirically or by experiment and are input from the input unit 106. The regeneration parameters include the cryopanel target temperature, the discharging completion condition, the first threshold value, and the second threshold value. The cryopanel target temperature includes the first regeneration temperature T0, the second regeneration temperature Ta, and the ultracold temperature Tb. Each of the first regeneration temperature T0, the second regeneration temperature Ta, and the ultracold temperature Tb maybe set as a certain single temperature or as a certain temperature range.

The cooldown process is a final process of regeneration to cool the cryopump 10 to the ultracold temperature Tb again. The ultracold temperature Tb is a cryopanel target temperature in the cooldown process. If the discharging completion condition is met, the discharging process is completed, and the cooldown process is started. The cooling operation of the refrigerator 16 is started. The temperature control unit 110 continues the cooldown process until the target cooling temperature is met and terminates the cooldown process if the target temperature is met. This completes the regeneration process. The vacuum pumping operation of the cryopump 10 is resumed. The temperature control unit 110 may be configured to perform the temperature control operation of the refrigerator 16 to maintain the temperature of the low-temperature cryopanel 18 or the high-temperature cryopanel 19 at its target temperature in the vacuum pumping operation.

Figure 3:
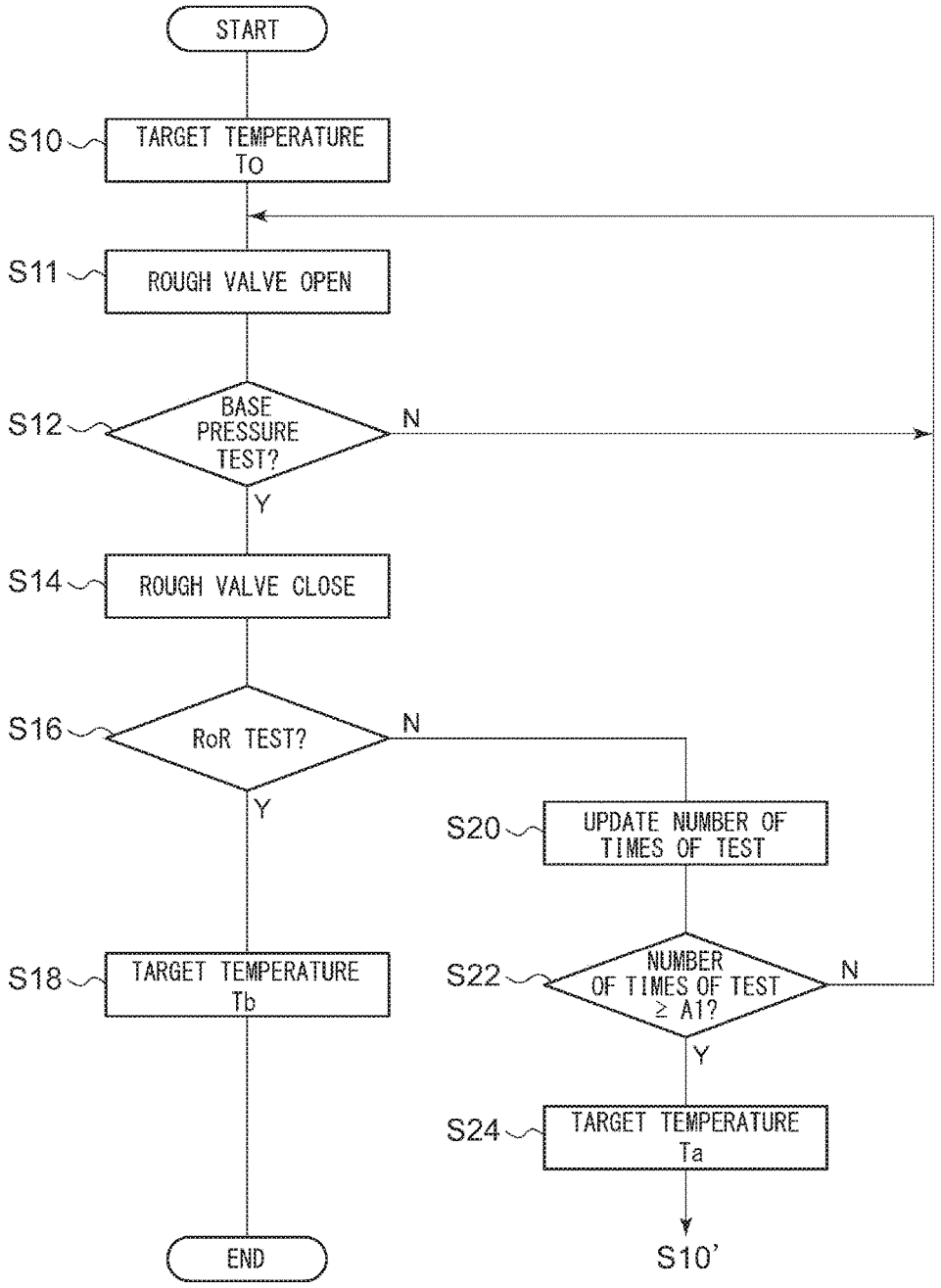
FIG. 3 is a flowchart showing a main part of a method for regenerating a cryopump according to an embodiment of the present invention.
Figure 4:
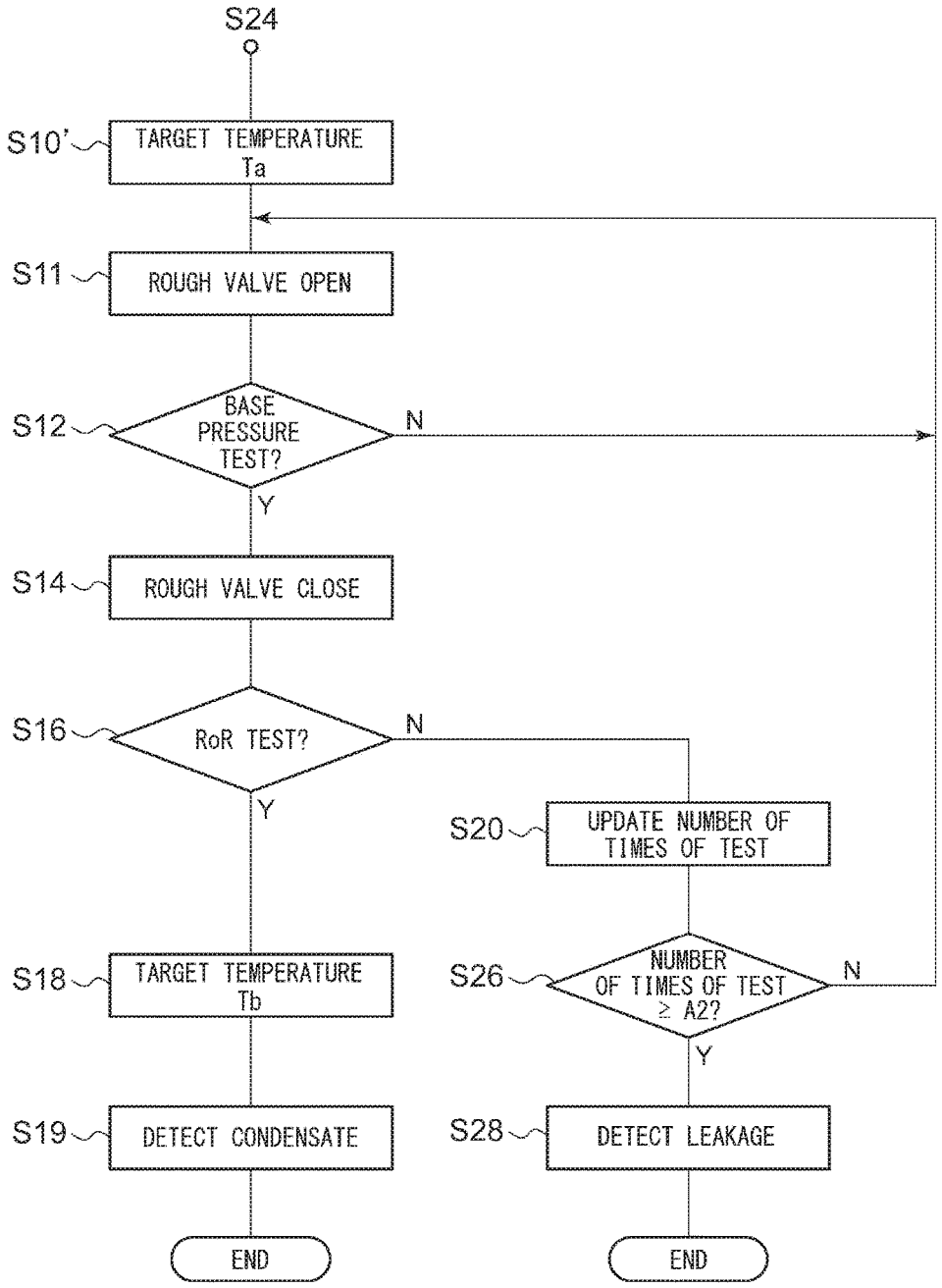
FIG. 4 is a flowchart showing a main part of the method for regenerating a cryopump according to an embodiment of the present invention.

FIGS. 3 and 4 illustrate a flowchart of a main part of a method for regenerating the cryopump according to an embodiment of the present invention. FIGS. 3 and 4 illustrate the discharging process in the full regeneration. As described above, the temperature control unit 110 sets the target temperature of the low-temperature cryopanel 18 and/or the high-temperature cryopanel 19 to the first regeneration temperature T0 (S10). Also, the regeneration control unit 102 opens the rough valve 72 and closes the purge valve 74 (S11). In this manner, rough evacuation of the housing 38 is performed. Meanwhile, the vent valve 70 is kept closed through the subsequent processes.

The first determination unit 112 performs a base pressure test (S12). That is, the first determination unit 112 determines whether the housing 38 is depressurized to the base pressure level within a predetermined period of time. For example, the first determination unit 112 determines the base pressure test is passed if the pressure measured by the pressure sensor 94 is equal to or lower than Y [Pa] when time X [min] has elapsed since the start of rough evacuation. The first determination unit 112 determines the base pressure test is failed if not the case. The threshold value Y [Pa] is pressure at the base pressure level.

The reason that the base pressure test is failed, that is, the reason that the pressure in the cryopump 10 does not drop sufficiently, is that a large amount of condensate still remains in the housing 38 and is evaporated under reduced pressure. Accordingly, if the base pressure test is failed (N in S12), the rough evacuation of the housing 38 (S11) and the base pressure test (S12) are performed again. The condensate is further discharged by the rough evacuation. Meanwhile, before and/or during the rough evacuation, the purge gas may be supplied to the housing 38.

If the base pressure test is passed (Y in S12), the regeneration control unit 102 closes the rough valve 72 (S14). In this manner, connection of the housing 38 to the outside is cut off, and the inside of the housing 38 is sealed in a vacuum state. Meanwhile, the regeneration control unit 102 may close the rough valve 72 after every execution of the base pressure test regardless of the result of the base pressure test.

In a state in which the inside of the housing 38 is maintained in a vacuum state, the first determination unit 112 performs the RoR test to determine whether the discharging completion condition is met (S16). For example, the first determination unit 112 determines the RoR test is passed if the pressure measured by the pressure sensor 94 is equal to or lower than Z [Pa] when time X' [min] has elapsed since the start of the test. The first determination unit 112 determines the RoR test is failed if not the case. The threshold value Z [Pa] is higher than the threshold value Y [Pa] for the base pressure test. However, Z [Pa] is also pressure at the base pressure level. The test time X' [min] maybe shorter than the time X [min] for the base pressure test.

If the RoR test is failed (N in S16), the second determination unit 114 updates the number of times of the RoR test (S20). That is, the second determination unit 114 adds 1 to the existing number of times of the RoR test. The updated number of times of the RoR test may be stored in the storage unit 104.

The second determination unit 114 determines whether the number of times of the RoR test is equal to or larger than the first threshold value A1 (S22). If the number of times of the RoR test is smaller than the value A1 (N in S22), the rough evacuation of the housing 38 (S11) and the base pressure test (S12) are performed again in a similar manner to that in the case in which the base pressure test is failed (N in S12).

If the number of times of the RoR test is equal to or larger than the value A1 (Y in S22), the temperature control unit 110 changes the cryopanel target temperature from the first regeneration temperature T0 to the second regeneration temperature Ta (S24). In this manner, the preliminary cooling process of the low-temperature cryopanel 18 and/or the high-temperature cryopanel 19 is started. The second determination unit 114 may reset the number of times of the RoR test when the cryopanel target temperature is changed.

If the RoR test is passed (Y in S16), the temperature control unit 110 changes the cryopanel target temperature from the first regeneration temperature T0 to the ultracold temperature Tb (S18). In this manner, the regeneration control unit 102 terminates the discharging process and starts the cooldown process.

FIG. 4 illustrates the preliminary cooling process of the cryopump 10 following S24 in FIG. 3. Several steps in the preliminary cooling process are similar to those described with reference to FIG. 3. Like numerals are used in the description to denote like elements and the description is omitted as appropriate.

As described above, the temperature control unit 110 sets the target temperature of the low-temperature cryopanel 18 and/or the high-temperature cryopanel 19 to the second regeneration temperature Ta (S10'). Also, the regeneration control unit 102 opens the rough valve 72 and closes the purge valve 74 (S11).

The first determination unit 112 performs the base pressure test again (S12). A threshold value for use in the base pressure test during the preliminary cooling is the same as that before the preliminary cooling. However, a different threshold value may be used. The regeneration control unit 102 closes the rough valve 72 after execution of the base pressure test (S14). If the base pressure test is failed (N in S12), the rough evacuation of the housing 38 (S11) and the base pressure test (S12) are performed again.

If the base pressure test is passed (Y in S12), the first determination unit 112 performs the RoR test again (S16). A threshold value for use in the RoR test during the preliminary cooling is the same as that before the preliminary cooling. However, a different threshold value may be used.

If the RoR test is failed (N in S16), the second determination unit 114 updates the number of times of the RoR test (S20). The second determination unit 114 determines whether the number of times of the RoR test is equal to or larger than the second threshold value A2 (S26). If the number of times of the RoR test is smaller than the value A2 (N in S26), the rough evacuation of the housing 38 (S11) and the base pressure test (S12) are performed again in a similar manner to that in the case in which the base pressure test is failed (N in S12).

Conversely, if the number of times of the RoR test is equal to or larger than the value A2 (Y in S26), the leakage detection unit 116 detects small leakage is occurring in the cryopump 10 (S28). The leakage detection unit 116 may store a detection result in the storage unit 104 and/or output it to the output unit 108. The regeneration control unit 102 may give a user a warning of generation of the small leakage and/or may stop the regeneration sequence.

If the RoR test is passed (Y in S16), the temperature control unit 110 changes the cryopanel target temperature from the second regeneration temperature Ta to the ultracold temperature Tb (S18). In this case, the condensate detection unit 118 detects a small amount of condensate remains (S19) and may store a detection result in the storage unit 104 and/or output it to the output unit 108. In this manner, the regeneration control unit 102 terminates the discharging process and starts the cooldown process.

The reason that the RoR test is failed in FIG. 3, that is, the reason that the pressure in the cryopump 10 is not maintained in the base pressure level, is that a small amount of substance that can be evaporated under reduced pressure remains in the housing 38. Since the condensates having high vapor pressure such as hydrogen and argon should already be discharged, the remaining substance is probably water or another condensate having low vapor pressure. The remaining substance may be an organic substance resulting from the vacuum process in the vacuum chamber to which the cryopump 10 is mounted.

The full regeneration sequence is inherently designed to discharge water from the cryopump 10 efficiently. Accordingly, water should be removed from the cryopump 10 through repetitive times of failure in the RoR test. As a result, the subsequent RoR test can be passed, which can induce transition from the discharging process to the cooldown process.

However, if an unknown condensate having lower vapor pressure than water remains in the cryopump 10, the condensate can be evaporated each time of depressurization of the housing 38 for the RoR test. As a result, the number of times of the RoR test to be repeated until the RoR test is passed may significantly exceed to the standard number of times of determination that does not assume such a condensate. In this case, the regeneration sequence may not be completed in a standard period of time required and be extended considerably. Since the regeneration time is downtime for the cryopump 10, extension of the regeneration time is not desirable.

Under such circumstances, in the present embodiment, the preliminary cooling of the cryopump 10 is performed after the RoR test is repeated a certain number of times. While the RoR testis repeated, discharge of water can be completed. In addition, by cooling the cryopump 10 to a lower temperature than the melting point of water, evaporation of the remaining condensate can be restricted. This can prevent unnecessary repetition of the RoR test and prevent excessive extension of the regeneration time.

In the regeneration sequence according to the present embodiment, transition from the preliminary cooling to the cooldown process is induced. Thereafter, the vacuum pumping operation of the cryopump 10 is performed. The cryopump 10 will be continuously cooled until subsequent regeneration. Under such an ultracold temperature environment, the remaining condensate is held in a stable manner in the cryopump 10. Accordingly, the remaining condensate does not have a negative effect on the vacuum pumping operation at all or at least does not have a significant negative effect on the vacuum pumping operation.

Also, just monitoring the pressure in the cryopump 10 makes it impossible or difficult to distinguish remaining of the condensate from generation of small leakage. However, according to the present embodiment, these two different phenomena can be distinguished as described above. In a case of leakage, it is not desirable to continue the operation of the cryopump 10, and an appropriate warning of the leakage can thus be given.

Described above is an explanation based on an exemplary embodiment. The invention is not limited to the embodiment described above and it will be obvious to those skilled in the art that various design changes and variations are possible and that such modifications are also within the scope of the present invention.

The number of times of determination for the discharging completion condition represents a period of time for which the discharging process continues. Thus, in an embodiment, the regeneration control unit 102 may use the period of time for which the discharging process continues instead of the number of times of determination for the discharging completion condition. In this case, as well as in the case of using the number of times of determination for the discharging completion condition, the regeneration time can be reduced.

The second determination unit 114 may determine whether the period of time for which the discharging process continues is equal to or larger than the first threshold value. The first threshold value may be higher than a standard period of time for which the discharging process continues required to remove the first condensate from the cryopump 10 in the regeneration sequence. The temperature control unit 110 may perform the preliminary cooling of the cryopump 10 if the period of time for which the discharging process continues is equal to or larger than the first threshold value.

The second determination unit 114 may determine whether the period of time for which the discharging process continues is equal to or larger than the second threshold value during the preliminary cooling of the cryopump 10. The leakage detection unit 116 may detect leakage of the cryopump 10 if the period of time for which the discharging process continues is equal to or larger than the second threshold value.

It should be understood that the invention is not limited to the above-described embodiment, but may be modified into various forms on the basis of the spirit of the invention. Additionally, the modifications are included in the scope of the invention.

What is claimed is:

1. A cryopump system comprising:

a cryopump; and a regeneration controller that controls the cryopump in accordance with a regeneration sequence including a discharging process for discharging a condensate from the cryopump, the discharging process being continued until a discharging completion condition based on pressure in the cryopump is met, wherein the regeneration controller includes:

a first determiner that determines in a repetitive manner whether the discharging completion condition is met;

a second determiner that determines whether the number of times of determination for the discharging completion condition or a period of time for which the discharging process continues is equal to or larger than a first threshold value; and a temperature controller that performs preliminary cooling of the cryopump if the number of times of determination for the discharging completion condition or the period of time for which the discharging process continues is equal to or larger than the first threshold value, and wherein the first determiner re-determines during the preliminary cooling whether the discharging completion condition is met.

2. The cryopump system according to claim 1, wherein the second determiner determines during the preliminary cooling whether the number of times of determination for the discharging completion condition or the period of time for which the discharging process continues is equal to or larger than a second threshold value, and wherein the regeneration controller includes a leakage detector that detects leakage of the cryopump if the number of times of determination for the discharging completion condition or the period of time for which the discharging process continues is equal to or larger than the second threshold value.

3. The cryopump system according to claim 1, wherein the regeneration sequence includes a temperature-raising process to heat the cryopump from an ultracold temperature to a first regeneration temperature that is equal to or higher than a melting point of a first condensate and a cooldown process to cool the cryopump to the ultracold temperature again if the discharging completion condition is met, and wherein the temperature controller cools the cryopump to a second regeneration temperature that is lower than the melting point of the first condensate and higher than the ultracold temperature in a preliminary manner if the number of times of determination for the discharging completion condition or the period of time for which the discharging process continues is equal to or larger than the first threshold value.

4. The cryopump system according to claim 3, wherein the first threshold value is higher than a standard number of times of determination for the discharging completion condition or a standard period of time for which the discharging process continues required to remove the first condensate from the cryopump in the regeneration sequence.

5. The cryopump system according to claim 3, wherein the first condensate is water.

6. The cryopump system according to claim 3, wherein the regeneration controller includes a condensate detector that detects a second condensate different from the first condensate remains if the discharging completion condition is met during the preliminary cooling.

7. The cryopump system according to claim 6, wherein the second condensate is an organic condensate.

8. The cryopump system according to claim 1, wherein the cryopump includes a cryopanel, a cryopump housing that encloses the cryopanel, and a pressure sensor that measures pressure in the cryopump housing, and wherein the first determiner determines in a repetitive manner whether the measured pressure in the cryopump housing is maintained at a cryopump operation start pressure or lower for a predetermined period of time.

9. A cryopump controller comprising:

a regeneration controller that controls a cryopump in accordance with a regeneration sequence including a discharging process for discharging a condensate from the cryopump, the discharging process being continued until a discharging completion condition based on pressure in the cryopump is met, wherein the regeneration controller includes:

a first determiner that determines in a repetitive manner whether the discharging completion condition is met;

a second determiner that determines whether the number of times of determination for the discharging completion condition or a period of time for which the discharging process continues is equal to or larger than a first threshold value; and a temperature controller that performs preliminary cooling of the cryopump if the number of times of determination for the discharging completion condition or the period of time for which the discharging process continues is equal to or larger than the first threshold value, and wherein the first determiner re-determines during the preliminary cooling whether the discharging completion condition is met.

* * * * *